United States Patent [19]

Gray

[11] 4,342,427

[45] Aug. 3, 1982

[54] ELECTROMAGNETIC FUEL INJECTOR

[75] Inventor: Leo A. Gray, Grand Rapids, Mich.

[73] Assignee: General Motors Corporation, Detroit, Mich.

[21] Appl. No.: 170,618

[22] Filed: Jul. 21, 1980

[51] Int. Cl.[3] ..... B05B 1/30

[52] U.S. Cl. ..... 239/585

[58] Field of Search ..... 239/585; 251/129, 141, 251/84, 85, 86

[56] References Cited

U.S. PATENT DOCUMENTS

| | | | |
|---|---|---|---|
| 1,775,999 | 9/1930 | Haseloff | 251/85 |
| 1,942,417 | 1/1934 | Ferlin et al. | 251/84 |
| 2,613,907 | 10/1952 | Stillwagon | 251/85 |
| 4,218,021 | 8/1980 | Palma | 239/585 |

*Primary Examiner*—Robert B. Reeves
*Assistant Examiner*—Gene A. Church
*Attorney, Agent, or Firm*—Arthur N. Krein

[57] ABSTRACT

A three-part valve means is used in an electromagnetic fuel injector to control fuel flow out through a metering orifice, defined by the valve means in an open position relative to an associated valve seat, to an injector discharge orifice located closely downstream of the metering orifice. The three-part valve means includes a valve member provided with a flat surface on one end thereof and a semi-spherical seating surface at its opposite end for seating engagement with the valve seat; a movable armature having a flat at one end thereof for abutment against the flat surface of the valve member; and, a valve retainer operatively connected to the armature for supporting the valve member with its flat surface in abutment against the flat of the armature for movement therewith, the valve retainer permitting the flat surface of the valve member to move transversely relative to the flat of the armature.

3 Claims, 7 Drawing Figures

ELECTROMAGNETIC FUEL INJECTOR

FIELD OF THE INVENTION

This invention relates to electromagnetic fuel injectors and, in particular, to a valve-armature arrangement for such injectors.

DESCRIPTION OF THE PRIOR ART

Electromagnetic fuel injectors are used in fuel injection systems for vehicle engines because of the capability of this type injector to effect the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one such type electromagnetic fuel injector that is presently in use on commercially available passenger vehicles, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

In this type injector, a first spring is positioned to normally bias the armature in a direction to effect seating of the valve member against the valve seat. A second spring is positioned on the downstream side of the valve seat to assist in effecting opening movement of the valve member relative to the valve seat when the armature is moved axially in an opposite direction against the bias of the first spring and to couple the valve to the armature. This second spring is thus positioned between the valve orifice, defined by the annular space between the valve member and its valve seat during an injector stroke, and the delivery orifice, which in this particular type injector is defined by a plurality of director passages provided in a director plate located downstream of the valve element, that is downstream in terms of the direction of fuel flow through the injector nozzle.

It has now been discovered that when using the above-described type electromagnetic fuel injector, air to fuel ratio rich shifts can occur when the fuel temperature reaches approximately 130° F. with, for example, a 4/6 pressure drop ratio for flow through the flow control orifices of the injector, that is, the valve orifice and the discharge orifice. This is due to the fact that the relatively large quantity of fuel contained in the passage of the injector nozzle between the valve orifice and the discharge orifice vaporizes due to pressure equalization to ambient pressure during the periods between valve energization. As this occurs, it will in turn permit more fuel to enter this space downstream of the valve orifice to cause a rich fuel shift, which shift can be as high as, for example, 20 percent to 25 percent during the pulse time interval when the valve member is opened.

SUMMARY OF THE INVENTION

Accordingly, a primary object of the present invention is to provide an improved electromagnetic fuel injector having a small fuel volume between the flow control orifices of the nozzle assembly of such an injector, compared to the volume of fuel to be injected, such as 1:4 to 1:5 ratio between fuel volume and injection volume.

Another object of the invention is to provide an improved electromagnetic fuel injector that advantageously utilizes a retainer for securing a valve member to an armature for axial movement therewith while still permitting the valve member to move laterally relative to the armature whereby to permit the volume between the flow control orifices of the injector to be substantially reduced.

A further object of the invention is to provide an improved electromagnetic fuel injector having a retainer which is adapted to hold a valve member firmly to an armature for axial movement therewith while still permitting the valve member to move laterally whereby the valve member is operative to effect self-alignment with its associated valve seat.

A still further object of the invention is to provide an improved electromagnetic fuel injector that includes a three-part valve means, one part being a valve member having a flat surface on one side thereof and being spherical opposite the flat; a second part being an armature with a flat face seating against the flat surface of the valve member; and, the third being a retainer holding the flat surface of the valve element in abutment against the flat face of the armature while permitting lateral movement of these flat surfaces relative to each other.

Still another object of the present invention is to provide an electromagnetic fuel injector of the above type which includes features of construction, operation and arrangement, rendering it easy and inexpensive to manufacture and to calibrate for desired fuel flow, which is reliable in operation, and in other respects suitable for extended use on production motor vehicle fuel systems.

The present invention provides an electromagnetic fuel injector having an injector nozzle at one end thereof, the injector nozzle having a discharge passage means therethrough including a discharge orifice means at one end and an annular valve seat encircling the opposite end of the passage means in relatively closely spaced relationship to the discharge passage means. A three-part valve means is movable relative to the valve seat to control fuel flow out through the discharge passage means. On part of the valve means is a valve member having a flat surface on one side thereof and being spherical opposite the flat surface to provide a spherical seating surface for valve closing engagement with the valve seat; the second part being an armature with a flat end face seating against the flat surface of the valve member in laterally slidable engagement therewith; and, the third part being a retainer loosely holding the valve member against the armature for axial movement therewith while permitting the valve member to effect its own self-alignment with the valve member.

For a better understanding of the invention, as well as other objects and further features thereof, reference is had to the following detailed description of the invention to be read in connection with the accompanying drawings.

DESCRIPTION OF THE EMBODIMENT

Figure 1:
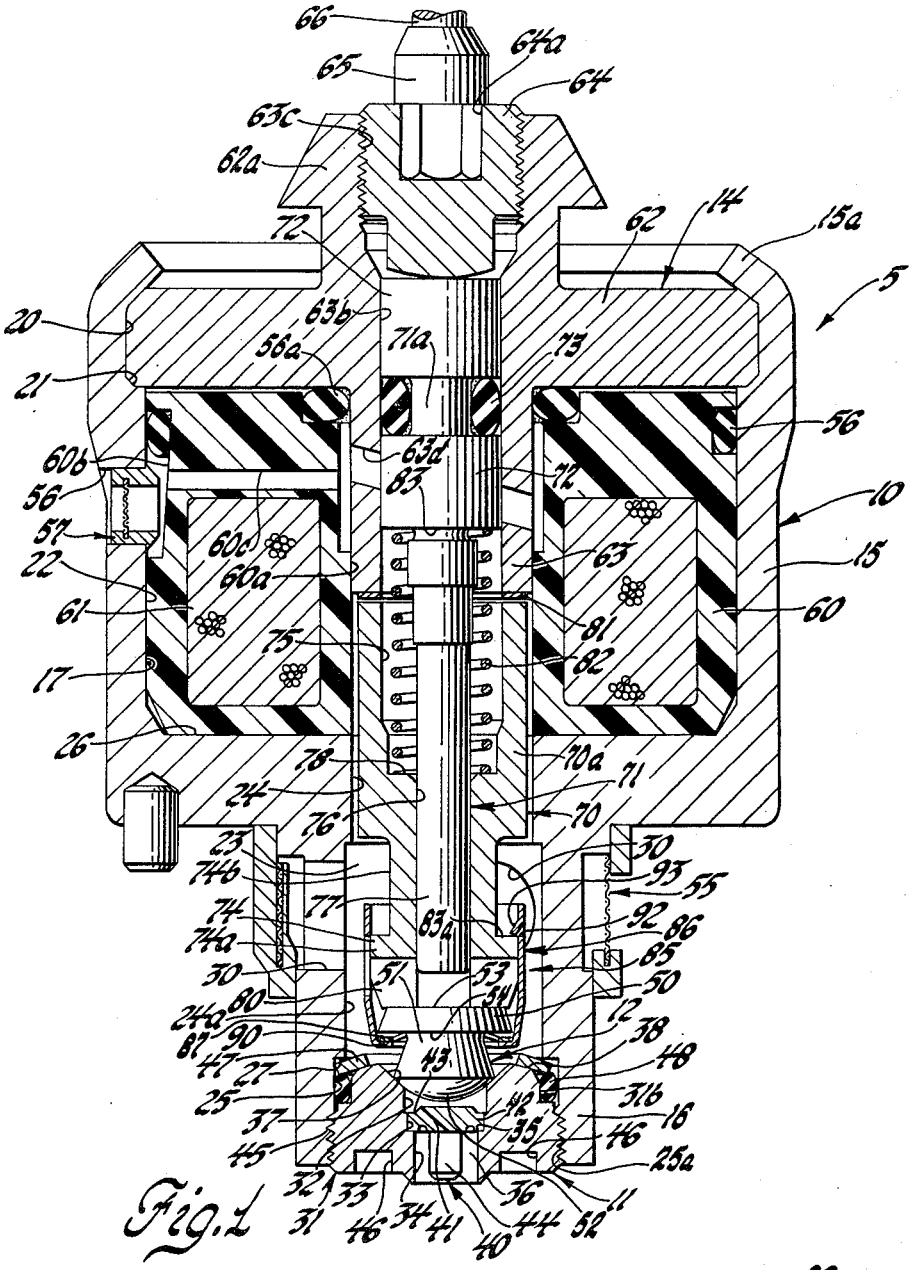
FIG. 1 is an enlarged, longitudinal cross-sectional view of an exemplary embodiment of an electromagnetic fuel injector having a preferred embodiment of a three-part valve means in accordance with the invention, incorporated therein, for controlling flow through a low volume fuel injector nozzle, the armature guide pin and valve member of the assembly being shown in elevation.

Referring first to FIG. 1, an electromagnetic fuel injector, generally designated 5, includes as major components thereof a body 10, a nozzle assembly 11, a valve member 12 and a solenoid assembly 14 used to control movement of the valve member 12.

In the construction illustrated, the body 10, is of circular hollow tubular configuration and is of such external shape so as to permit direction insertion, if desired, of the injector 5 into a socket provided for this purpose in either an engine intake manifold, not shown, or in the injector mechanism of a throttle body injection apparatus, not shown, for an engine.

The body 10, includes an enlarged upper solenoid case portion 15 and a lower end nozzle case portion 16 of reduced external diameter relative to portion 15. An internal cylindrical cavity 17 is formed in the body 10 by a stepped vertical bore therethrough that is substantially coaxial with the axis of the body. In the construction shown, the cavity 17 provides a cylindrical upper wall 20, a cylindrical upper intermediate wall 22, a cylindrical lower intermediate wall 24 and a cylindrical lower wall 25. Such walls 20, 22 and 24 are of progressively reduced diameters relative to the wall next above, while the lower wall 25 is of enlarged diameter relative to wall 24 for a purpose to be described. In the construction shown, the cylindrical wall 24 is of stepped diameters whereby to provide an upper portion 24 of a diameter to loosely slidably receive the large diameter portion 70*a* of an armature 70, to be described in detail hereinafter, and a lower cylindrical wall portion 24*a* of a diameter greater than the wall portion 24 but less than that of lower wall 25. Walls 20 and 22 are interconnected by a shoulder 21. Walls 22 and 24 are interconnected by a shoulder 26. Walls 24 and 25 are interconnected by a shoulder 27.

Wall portion 24*a* defines the outer peripheral extent of a fuel chamber 23, to be described in greater detail hereinafter, within the body 10. The body 10 in the construction shown, is preferably provided with three, circumferentially equally spaced apart, radial port passages 30 in the nozzle case portion 15 thereof which open through the wall 24*a* to effect flow communication with the fuel chamber 23.

The injection nozzle assembly 11, mounted in the lower nozzle case portion 16 of body 10, includes a seat element 31 and a swirl director 40 supported in the seat element.

In the embodiment shown, the seat element 31 is provided with a central axial stepped bore to provide a discharge passage 36 therethrough defined by cylindrical walls, which in the construction illustrated, includes upper wall 32, intermediate wall 33 and lower wall 34. Walls 33 and 34 are of progressively reduced diameters relative to wall 32 and are interconnected by flat shoulder 35. The seat element 31 is also provided with a conical valve seat 37 on its upper surface 38, the valve seat being formed concentric with and encircling the upper wall of the discharge passage 36. The upper surface 38 of the seat element 40, in the embodiment illustrated, is downwardly tapered radially outboard of valve seat 37. The tapered surface next adjacent to valve seat 37 is formed at an angle of, for example, 25° from the horizontal so as to provide an abutment shoulder for one side of an abutment washer for a purpose to be described.

The swirl director 40 is provided with a plurality of circumferentially, equally spaced apart, inclined and axially extending director passages 41 that extend through the upper cylindrical flange portion 42 of the swirl director. Preferably, six such passages are used, although only one such passage is shown in FIG. 1. These director passages 41, of predetermined equal diameters, extend at one end downward from an annular groove 43 provided on the upper outboard surface of the flange portion of swirl director 40.

As shown, the flange portion 42 is of a suitable diameter whereby it can be secured as by a press fit into the intermediate wall 33 portion of discharge passage 36 so as to abut against the shoulder 35 within the seat element 31. The lower end of each director passage 41, as shown, is positioned so as to encircle a depending boss 44 formed integral with the flange portion 42 to extend vertically downward therefrom. The boss 44 thus extends vertically downward loosely into the reduced diameter lower end of discharge passage 36, that is, it is radially spaced inward of the lower wall 34. As shown, the upper surface of the swirl director 40 is thus positioned in relatively close but in axial spaced relationship to the valve member 12, when the latter is in its seated position, as shown, whereby only a relatively small fuel volume will be retained in the discharge passage between the swirl director 31 and valve member 12.

In the construction shown, the outer peripheral surface of the seat element 31 is provided with external threads 45 for mating engagement with the internal threads 25*a* provided in the lower end of the body 10. Preferably the threads 25*a* and 45 are of suitable fine pitch whereby to limit axial movement of the seat element as desired, for each full revolution of the seat element 31 relative to body 10 as desired. The lower face of the seat element 31 is provided, for example, with at least a pair of diametrically opposed blind bores 46, of a size so as to slidably receive the lugs of a spanner wrench, not shown, whereby rotational torque may be applied to the seat element 31 during assembly and axial adjustment of this element in the body 10.

With the structural arrangement shown the stroke of the injector, that is of valve member 12 and armature 70, can be accurately adjusted by the use of a collapsible abutment member between the upper surface of the valve seat element 31 and the shoulder 27 of the body 10. The collapsible abutment member, in the construction shown, is in the form of a flat spring abutment washer 47 of a suitable outside diameter to be slidably received within the lower wall 25 so as to abut against shoulder 27 located a predetermined axial distance from the lower flat end of the pole 63 of the solenoid assembly, to be described hereinafter. The washer 47 when first installed would be flat. As thus assembled, the upper outer peripheral edge of the washer 47 would engage against the outer radial edge portion of the shoulder 27 and its radial inner edge on the opposite side of the washer would abut against the upper tapered surface 38 of the seat element 31. With the washer 47, seat element 31, and swirl director 40, thus assembled with the seat element 31 in threaded engagement with internal threads 25*a*, these elements can then be axially adjustably positioned within the lower end of the body 10.

After these elements are thus intially loosely assembled, the injector is then calibrated on a calibration flow stand. During calibration of the injector, adjustment of the injector stroke is made while the injector is flowing calibration fluid on a continuous basis. During flow of the calibration fluid, an operator, through the use of a spanner wrench, not shown, can rotate the seat element 31 in a direction whereby to effect axial displacement thereof in an upward direction with reference to FIG. 1. As the nozzle assembly is moved axially upward by rotation of the seat element 31, it will cause the abutment washer 47 to deflect or bend into a truncated cone shape, the position shown in FIG. 1, to thereby, in effect, forcibly move the lower abutment surface of the washer 47 upward relative to the fixed shoulder 27 until the desired flow rate is achieved, thereby establishing the proper stroke length of the armature/valve for that injector. The seat element 31 is then secured against rotation relative to the body 10 by any suitable means such as, for example, by laser beam welding at the threaded interface connection of these elements.

With the above described arrangement, the effective flow orifice of the valve and valve seat interface as generated by injector stroke is controlled directly within very close tolerances by an actual flow measurement rather than by a mechanical displacement gauge measurement and this is accomplished after assembly of the injector. Also, with this arrangement, the necessity of gauging and of selective fitting of various components is eliminated. In addition, less injector rework after assembly would be required since means are provided to vary the stroke as desired.

An O-ring seal 48 is operatively positioned to effect a seal between the seat element 31 and the wall 25. In the construction shown in FIG. 1, the seat element 31 is provided with an external reduced diameter wall 31*b* adjacent to its upper end to receive the O-ring seal 48. The ring seal 48 is retained axially in one direction by the flat shoulder of the seat element 31 and in the opposite direction by its abutment against the lower surface of abutment washer 47.

Flow through the discharge passage 36 in seat element 31 is controlled by the valve member 12 which is loosely received within the fuel chamber 23. This valve member 12 is movable vertically between a closed position at which it is seated against the valve seat 37 and an open position at which it is unseated, from the valve seat 37, as described in greater detail hereinafter.

In the embodiment shown in FIG. 1, the valve member 12 is of a T-shaped overall configuration when viewed in elevation, with the lower end thereof being of ball-like configuration, with reference to FIG. 1, to provide a semi-spherical seating surface for engagement against the valve seat 37. Thus in the embodiment shown in FIG. 1, the valve member 12 includes an upper cylindrical head 50 with a depending, tapered, cylindrical shank 51 of reduced diameter depending therefrom. Shank 51 terminates at its lower or free end in a semi-spherical seating surface 52 for engagement against the valve seat 37. Thus the lower seating surface 52 portion of valve member 12 is of semi-spherical configuration whereby to be self-centering when engaging the conical valve seat 37.

As shown, the head 50 of the valve member 12 is provided with a flat surface 53 at its free or upper end surface and an annular flat abutment shoulder 54 on its opposite or lower surface that extends radially outward from the reduced diameter end of shank 51, all for a purpose to be described. Valve member 12 may be made of any suitable hard material which may be either a magnetic or non-magnetic material.

To effect filtering of the fuel being supplied to the injector 5 prior to its entry into the fuel chamber 23, there is provided a fuel filter assembly, generally designated 55. The fuel filter assembly 55 is adapted to be suitably secured, as for example by predetermined press fit, to the body 10 in position to encircle the radial port passages 30 therethrough.

The solenoid assembly 14 of the injector 5 includes a tubular coil bobbin 60 supporting a wound wire coil 61. Bobbin 60 is positioned in the body 10 between the shoulder 26 thereof and the lower surface of a circular, radial flange portion of a pole piece 62 that is slidably received at its outer peripheral edge within the wall 20. Pole piece 62 is axially retained within body 10, as by having its flange portion sandwiched between the shoulder 21 and the radially inward spun over upper rim 15*a* of the body. Seals 56 and 56*a* are used to effect a seal between the wall 22 and the upper end of bobbin 60 and between the upper end of bobbin 60 and the lower surface of pole piece 62.

Formed integral with the pole piece 62 and extending centrally downward from the flange portion thereof is a tubular pole 63. Pole 63 is of a suitable external diameter so as to be slidably received in the stepped bore aperture 60*a* that extends coaxially through the bobbin 60. The pole 63, as formed integral with the pole piece 62, is of a predetermined axial extent so as to extend a predetermined axial distance into the bobbin 60 in axial spaced apart relation to the shoulder 27 of body 10. The pole piece 62, in the construction illustrated, is also provided with an upstanding central boss 62*a* that is radially enlarged at its upper end for a purpose which will become apparent.

Pole piece 62 and its integral pole 63 are formed with a central through stepped bore 63*b*. The cylindrical annular wall, defined by the bore 63*b* is provided at its upper end within the enlarged portion of boss 62*a*, with internal threads 63*c*. An adjusting screw 64, having a tool receiving aperture 64*a*, for example, at its upper end, is adjustably threadedly received by the threads 63*c*.

The flange portion of pole piece 62 is also provided with a pair of diametrically opposed circular through slots, not shown, that are located radially outward of boss 62*a* so as to receive the upright circular studs 65 of bobbin 60, only one such stud 65 being shown in FIG. 1. Each such stud 65 has one end of a terminal lead 66 extending axially therethrough for connection to a suitable controlled source of electrical power, as desired. The opposite end, not shown, of each such lead 66 is connected, as by solder, to a terminal end of coil 61. The terminal end, not shown, of coil 61, the studs 65, and of the through slots in the pole piece 62 are located diametrically opposite each other whereby to enhance the formation of a more uniform and symmetrical magnetic field upon energization of the coil 61 to effect movement of the cylindrical armature 70 upward without any significant side force thereon to thereby eliminate tilting of the armature. Such tilting would tend to increase the sliding friction of the armature 70 on its armature guide pin 71, next described hereinafter.

A cylindrical armature guide pin 71, made of suitable non-magnetic material, is provided with axially spaced apart enlarged diameter upper end portions whereby to define axially spaced apart cylindrical lands 72 that are of a diameter whereby they are guidingly received in bore 63*b* of the pole piece 63 so as to effect coaxial alignment of the armature guide pin 71 within this bore and thus within the body 10. The enlarged upper end of the armature guide pin 71 is positioned to abut against the lower rounded surface of the adjusting screw 64.

A suitable seal, such as an O-ring seal 73, is sealingly engaged against a wall portion of the pole 63 defining bore 63*b* and a reduced diameter portion 71*a* of the armature guide pin 71 between the lands 72.

In the construction illustrated, a fuel return and vent port 56 having a second fuel filter assembly 58 fixed therein is provided in body 10 at a location to be in flow communication with an axial groove 60*b* in the outer peripheral surface of coil bobbin 60. A radial passage 60*c* interconnects groove 60*b* with an annular chamber defined by the reduced diameter, upper internal wall portion provided by aperture 60*a* in bobbin 60 and the outer cylindrical surface of pole 63. In addition, pole 63 is provided with an inclined through port 63*d* so as to be below the normal installed position of the reduced diameter portion 71*a* of the armature guide pin 71.

The armature 70 of the solenoid assembly 14 is of a cylindrical tubular construction with an upper portion 70*a* of an outside diameter whereby this armature is loosely slidably received within the lower intermediate wall 24 of the body 10 and in the lower guide portion of the bore aperture 60*a* of bobbin 60 and a stepped lower reduced diameter portion 74.

Armature 70 is formed with a stepped central bore therethrough to provide an upper spring cavity portion defined by an internal cylindrical upper wall 75 of a suitable predetermined inside diameter and a lower cylindrical pin guide bore wall 76 portion of a preselected smaller inside diameter than that of upper wall 75 and of a size whereby to slidably receive the lower, reduced diameter guide stem 77 portion of the armature guide pin 71. As previously described, the armature 70 is axially guided for movement relative to the lower end of pole 63 by the guide stem 77 of armature guide pin 71. As shown, the upper wall 75 and the guide bore wall 76 of the armature 70 are interconnected by a flat shoulder 78 for a purpose which will become apparent.

The armature 70 at its lower end is provided with at least one central radial extending through narrow slot 80 formed at right angles to the axis of the armature.

As shown in FIG. 1, the armature 70 is slidably positioned for vertical axial movement as guided by the armature guide pin 71 between a lowered position, as shown, at which it abuts against the upper flat surface 53 of valve member 12 to force this valve into seating engagement with the valve seat 37 and a raised position at which the upper flat end of the armature 70 abuts against a non-magnetic shim 81, preferably fixed, as by diffusion bonding, to the lower end face of pole 63. Shim 81 is used to provide a minimum fixed air gap between the pole 63 and the armature 70 when the latter is in its raised position. When the armature 70 is in its lowered position, a working air gap is established between the lower end of the pole 63 and the upper end of the armature 70, as shown in FIG. 1.

Armature 70 is normally biased to its lowered position, as shown, with the valve member 12 seated against the valve seat 37 by means of a coiled return spring 82 which is of a predetermined force value. Spring 82 is suitably received in the spring cavity within the armature 70 and in the bore of pole 63. The spring 82 is thus positioned to encircle the lower end of the guide pin 71, including the exposed portion its guide stem portion 77, with one end of the spring positioned to abut against the surface provided by radial flat shoulder 78 at the bottom of the spring cavity in armature 70 and, at its opposite end, the spring 82 abuts against a radial flat surface 83 of the armature guide pin 71 whereby to also bias this guide pin into abutment against the adjusting screw 64.

Figure 2:
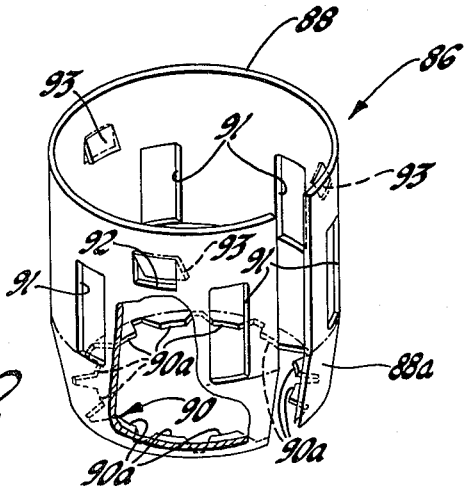
FIG. 2 is an enlarged perspective view of the retainer, per se, of the injector of FIG. 1, with a part thereof broken away to show the valve retainer tabs thereof.

Now in accordance with the invention, a valve retainer is used to attach the valve member to the armature for axial movement therewith and to effect unseating of the valve member 12 from the associated valve seat 37 during an injection stroke of the armature. In the preferred embodiment shown in FIGS. 1 and 2, the valve retainer, generally designated 85, includes a retainer 86 and a wave spring washer 87 that is positioned in and supported by the retainer.

The retainer 86, made, for example, of stainless steel, is of split, cylindrical, cup-shaped configuration. Thus retainer 86 includes a split cylindrical wall 88 upstanding from a centrally aperture base 90. Opposed edges of wall 88 and of base 90 are spaced apart so as to define a gap therebetween. In the construction illustrated, wall 88 is tapered radially inward at its lower end 88*a*. Thus this lower end 88*a* of the wall 88 terminates at the split, radial inward extending, centrally apertured base 90, which in the construction illustrated, consists of a plurality of radially inward extending, spaced apart tabs 90*a*. In the construction illustrated, eleven such tabs are used, FIG. 2, whereby the retainer 86 can be more easily fabricated from an original, rectangular, flat sheet material. As best seen in FIG. 1, the tabs 90*a* extend at substantially right angles to the longitudinal axis of the retainer wall 88.

The effective inside diameter of the centrally aperture base 90, that is, the effective distance between the free ends of a set of diametrically opposed tabs 90*a*, is substantially greater than the maximum outside diameter of the shank 51 of associated valve member 12 but, substantially less than the outside diameter of the head 50 of valve member 12, for a purpose described hereinafter.

In a similar manner, the wave spring washer 87 is provided with a central through aperture having an inside diameter that is substantially greater than the maximum outside diameter of the shank 51 of valve member 12, but substantially less than the outside diameter of the head 50 thereof. The outside diameter of the wave spring washer 87 is of a suitable dimension whereby the wave spring washer 87 is loosely received within the split cylindrical wall 88 of retainer 86 so that it can be supported by the base 90 thereof.

The split cylindrical wall 88 of retainer 86 is provided with a plurality of circumferentially spaced apart through slots 91, each of suitable size and configuration to provide a suitable flow area for the passage of fuel therethrough. Adjacent to its upper free end, the split cylindrical wall 88 is suitably pierced, as at 92, so as to provide a plurality of circumferentially spaced apart retainer tabs 93, each of which is bent so as to extend radially inward of the main body of wall 88. Three such retainer tabs are used in the retainer 86 construction illustrated in FIG. 2.

These retainer tabs 93 are used to effect attachment of the retainer 86 to the armature 70. For this purpose, the armature 70, in the embodiment shown in FIG. 1, has its reduced diameter lower portion 74 made of stepped configuration whereby there is provided a lower end portion **74*a* of predetermined axial extent and an upper portion 74*b* of reduced diameter relative to the portion 74*a* whereby to provide a flat retainer shoulder 83*a* against which the lower free ends of the retainer tabs 93 can abut when the valve retainer 85 is assembled to the armature 70, as shown in FIG. 1**.

As best seen in FIG. 1, the axial extent between the lower or free end edge of each retainer tab 93 and the upper surface of the base 90 is a predetermined extent greater than the axial extent of the lower portion **74*a* of armature 70 and the thickness of the head 50 of valve member 12 so as to facilitate the assembly of the valve member 12 and the retainer 86 to the associated armature 70. However, the as formed height or axial extent of the wave spring washer 87 is at least as great as but, preferably greater than this predetermined extent whereby, with the valve member 12 and valve retainer 85 assembled to the armature 70, as shown in FIG. 1, the wave spring washer 87, of a predetermined spring force, is operative to bias the flat surface 53 of the valve member 12 against the lower flat surface of the armature 70, while at the same time biasing the retainer 86 in an axial direction, downward with reference to FIG. 1, whereby the retainer tabs 93 are forced into abutment against the flat retainer shoulder 83** of the armature.

Preferably the split cylindrical upright wall 88 of the retainer 86 is fabricated so as to have an inside diameter substantially the same as the outside diameter of the lower portion **74*a* of the armature. It will however be apparent that, since the retainer 86 is of split cup-shaped configuration, the wall 88 can be radially expanded during its assembly to the armature so as to permit the retainer tabs 93 to pass over the outer peripheral surface of the lower portion of the armature. As retainer 86 is axially forced onto the armature 70, the wave spring washer 87 will be compressed sufficiently to allow retainer 86 to be moved axially a sufficient distance to permit the retainer tabs 93 to pass over the flat retainer shoulder 83, after which the retainer 86 can then be released whereby the free ends of the retainer tabs 91 can then move radially inward to a position for abutment against the flat retainer shoulder 83. As this occurs, the split cylindrical wall 86 of the valve retainer will again assume its, as formed, cylindrical configuration shown in FIG. 2. At the same time, the wave spring washer 87 will effect axial movement of retainer in a direction so that retainer tabs 93 will then engage the flat retainer shoulder 83 to effect retention of retainer 86 on armature 70**.

As shown in FIG. 1, the valve retainer 85 as thus assembled to the armature 70 is thus operative to retain valve member in abutment against the lower flat surface of the armature 70 for axial movement therewith. However, with the structural arrangement of the valve retainer 85, as illustrated and described, the valve member 12 is still free to move laterally relative to this flat surface of the armature whereby the semi-spherical seating surface 52 of the valve member 12 upon engagement with the valve seat 37 can effect self-alignment of the valve member with the valve seat.

It will be apparent that with the arrangement described hereinabove there is provided a three-part valve means for the injector 5, which valve means includes the armature 70, valve member 12 and the valve retainer.

Alternate embodiments of three-part valve means in accordance with the invention are illustrated in FIGS. 3, 4, 5–6, and 7, respectively, wherein similar parts are designated by similar numerals but with the addition of a prime (′) or the next hundred series number where appropriate.

Figure 3:
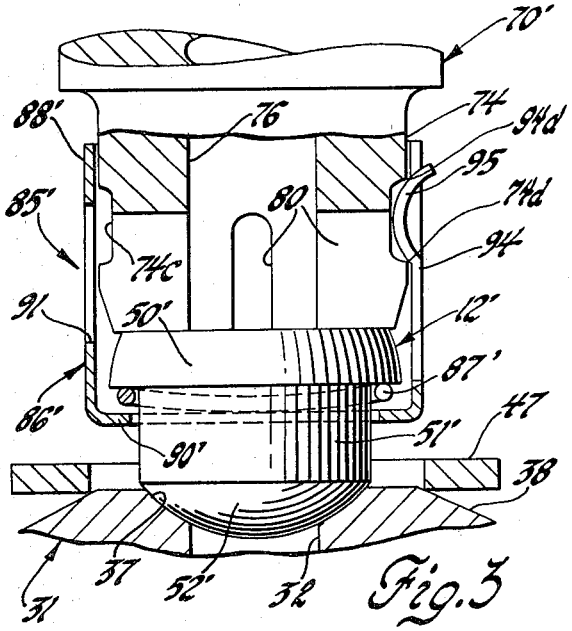
FIGS. 3, 4 and 5 are elevational sectional views of a portion only of the injector of FIG. 1, having alternate embodiments of three-part valve means, in accordance with the invention, incorporated therein, with the abutment washer for the associated valve seat element shown in its normal, as fabricated form.

Referring now to FIG. 3, the valve member 12′ in this alternate embodiment is similar to valve member 12 except that valve member 12′ has a straight shank 51′. Valve retainer 85′ in this embodiment also includes a cup-shaped retainer 86′ and an annular waved spring washer 87′ formed of round wire.

Retainer 86′ includes a cylindrical wall 88′ that extends upward from a centrally apertured base 90′. This element may be of split ring configuration or, as shown, may be of continuous annular configuration. Wall 88′ is provided with a plurality of circumferentially spaced apart through slots 91 and, intermediate these slots 91 the wall is suitably pierced or slit, starting from its upper edge, at pairs of circumferentially spaced apart locations so as to define between adjacent slits a spring retainer finger 94. For example, in a particular construction the wall 88′ was provided with five such slots 91 and five such spring retainer fingers 94, only one of each being shown in FIG. 3. Each such spring retainer finger 94 is formed next adjacent to its free end with an inwardly curved detent 95 adapted to project into a suitable annular groove **74*c* provided for this purpose in the lower end 74 of armature 70′. Groove 74*c* is located a suitable predetermined axial distance above the lower end surface of the armature 70′ whereby the edges of opposed side walls 74*d* defining this groove can be engaged by the opposed curved portions of the detent 95 as shown in FIG. 3**.

Figure 4:
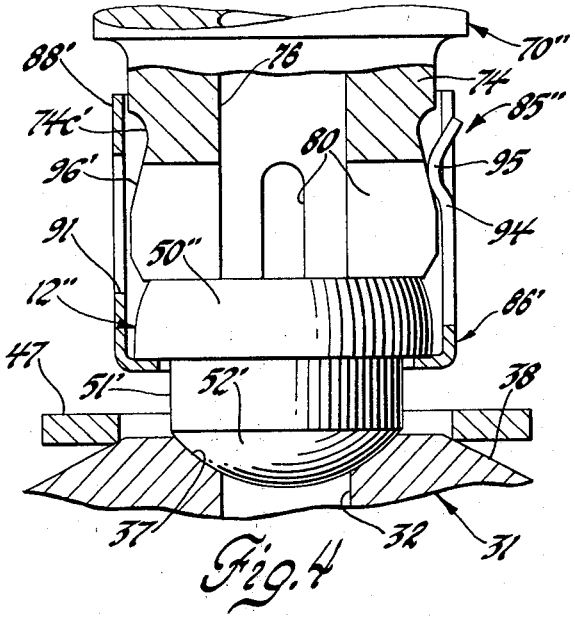

Referring now to the embodiment illustrated in FIG. 4, in this embodiment, the valve member 12″ is similar to valve member 12′ of FIG. 3, but with the axial extent of its head 50″ increased relative to that of the head 50′ in FIG. 3. With this arrangement, the valve retainer 85″ in this embodiment need consist only of the cup-shaped retainer of FIG. 3 and, the annular groove **74*c*′ provided in the armature 70″ to receive the detents 95 of the retainer 86′ is defined in part by an upward extending and inwardly inclined cam wall 96**.

Figure 5:
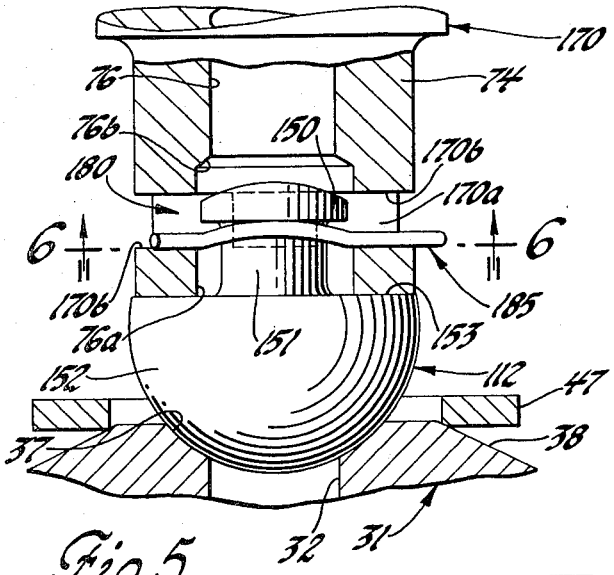
Figure 6:
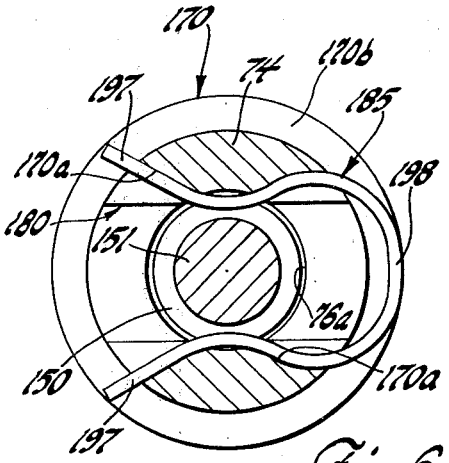
FIG. 6 is a cross-sectional view of the alternate embodiment three-part valve means of FIG. 5 taken along 6—6 of FIG. 5; and, FIG. 7 is an elevational view of a portion only of the injector of FIG. 1 having still another alternate embodiment three-part valve means in accordance with the invention incorporated therein.

In the alternate embodiment of the three-part valve means shown in FIGS. 5 and 6, the valve member 112 includes a lower ball-like element, truncated at one end whereby to provide an annular flat surface 153 on its upper side, the lower portion defining a semi-spherical seating surface 152. Upstanding therefrom is a reduced diameter shank 151 that terminates at a head 150. Head 150 is of a greater outside diameter than shank 151 but of smaller diameter than the outside diameter of the semi-spherical seating surface 152.

The valve retainer 185, in the embodiment illustrated in FIGS. 5 and 6, is in the form of a waved, hairpin type retainer clip made of spring wire. Valve retainer 185 thus includes a pair of oppositely return-bent and waved spring legs 197 interconnected at one end by a curved base 198.

The armature 170 used in this embodiment has the bore therethrough stepped at its lower end to provide an enlarged diameter cylindrical lower wall 76*a* of a predetermined axial extent greater than the axial extent of head 150 and shank 151 of valve member 112. The inside diameter of lower wall 76*a* is made suitably larger than the outside diameter of head 150 of valve member 112 so that lower wall 76*a* can loosely receive this head and still permit movement thereof at right angles to the longitudinal axis of the armature 170. Lower wall 76*a* is connected to pin guide bore wall 76 by a shoulder 76*b*. Armature 170 is also provided with a through slot 180 located a predetermined axial extent above the bottom end of armature 170 so as to break into the lower wall 76*a* intermediate its ends. This slot is formed by machining so as to provide spaced apart, opposed, curved side walls 170*a* formed complimentary to the legs 197 of the valve retainer 185 and, opposed flat walls 170*b*.

Valve retainer 185 as assembled to the valve member 112 and armature 170, has its legs 197 partly encircling the shank 151 of the valve member 112, with the flat portions of these legs abutting against the lower flat wall 170*b* while the waved portions thereof abut against the bottom surface of the head 150 whereby to bias the flat surface 153 of valve member 112 into abutment against the bottom face of armature 170. The spring force of valve retainer 185 is preselected so as to permit transverse movement of valve member 112 relative to armature 170 whereby the valve member can be self-centering with respect to the valve seat 37 of associated seat element 31.

Figure 7:
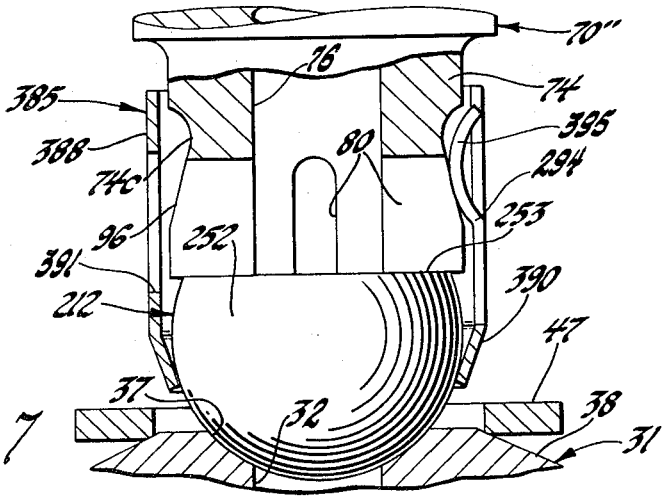

In the alternate embodiment of the three-part valve means shown in FIG. 7, the valve member 212, in this embodiment, is made in the form of a ball which is truncated at one end whereby to provide a flat surface 253 on its upper side, the lower seating surface portion 252 thereof being of semi-spherical configuration whereby to be self-centering when engaging the conical valve seat 37 of the associated seat element 31.

The valve retainer 385 in the embodiment of FIG. 7 is in the form of a cylindrical tubular retainer having a cylindrical upper wall 388 that terminates at an inwardly tapered, cylindrical lower wall 390. The effective minimum inside diameter of lower wall 390 is preselected relative to the maximum effective outside diameter of the valve member 212 whereby this lower wall 390, in effect, defines a centrally apertured base for the valve retainer 385 which is adapted to support the valve member 212 in in the manner illustrated.

Upper wall 388 is provided with a plurality of circumferentially spaced apart spring fingers 294, each with a curved detent 395 portion thereon and with spaced apart through slots 391, in a manner similar to the structure of the retainer 86' of FIGS. 3 and 4. Accordingly, the valve retainer 385 is retained on its associated armature 70'' in the same manner described relative to the connection of valve retainer 85'' on armature 70'' of FIG. 4.

The embodiments of the invention in which an exclusive property or privilege is claimed are defined as follows:

1. An electromagnetic fuel injector including a housing means providing a fuel chamber therein intermediate its ends adapted to receive fuel and a passage from said chamber through which fuel is injected to an engine; said passage defining an annular valve seat where said passage communicates with said chamber; a solenoid pole piece fixed in said housing means axially spaced from said valve seat; an electromagnetic actuated valve means positioned in said housing means, said electromagnetic actuated valve means including a movable valve having a flat on one end thereof and a semi-spherical surface on the opposite end for valve-closing engagement with said valve seat, a cylindrical armature having a reduced diameter cylindrical portion at one end thereof terminating at a flat surface at the free end thereof abutting against said flat of said valve and, a retainer means operatively associated with said reduced diameter portion of said armature and with said valve for loosely securing said valve to said armature for axial movement therewith while permitting lateral movement of said flat of said valve relative to said flat surface of said armature whereby said valve is free to center itself relative to said valve seat upon engagement therewith; said armature being axially movable between a first position at which said valve is in valve closing engagement with said valve seat and a second position at which said valve is in open position relative to said valve seat; and, a valve closing spring positioned to act on said armature in a direction moving said armature to said second position.

2. An electromagnetic fuel injector including a housing means providing a fuel chamber therein intermediate its ends adapted to receive fuel and a passage from said chamber through which fuel is injected to an engine, said passage defining an annular valve seat where said passage communicates with said chamber; a solenoid pole piece fixed in said housing means in spaced apart relationship to said valve seat; a three-part valve means movably positioned in said housing means between said pole piece and said valve seat, said three-part valve means including a movable valve having a flat on one end thereof and a semi-spherical surface on the opposite end for valve-closing engagement with said valve seat, a cylindrical armature having a reduced diameter cylindrical portion at one end thereof with a flat surface thereon for abutment against said flat of said valve and, a retainer means operatively fixed to said reduced diameter portion of said armature and operatively supporting said valve against said armature for axial movement therewith while permitting lateral movement of said flat of said valve relative to said flat surface of said armature whereby said valve is free to center itself relative to said valve seat; said armature being axially movable between a first position at which said valve is in valve closing engagement with said valve seat and a second position at which said valve is in open position relative to said valve seat; and, a valve closing spring operatively positioned to act on said armature in a direction moving said armature to said second position.

3. An electromagnetic fuel injector including a housing means providing a fuel chamber therein intermediate its ends adapted to receive fuel and a passage from said chamber through which fuel is injected to an engine, said passage defining an annular valve seat where said passage communicates with said chamber; an electromagnetic actuated valve means positioned in said housing means, said electromagnetic actuated valve means including a solenoid pole piece fixed to said housing means and a three-part valve means positioned for movement between said solenoid pole piece and said valve seat; said three-part valve means including a movable valve having a flat on one end thereof and a semi-spherical surface on the opposite end for valve-closing engagement with said valve seat, a cylindrical armature having a reduced diameter cylindrical portion at one end thereof terminating a flat surface adjacent the free end thereof for abutment against said flat of said valve and, a retainer means operatively associated with said reduced diameter portion of said armature and with said valve for loosely securing the flat on one end of said valve against the flat surface of said armature for axial movement of said valve with said armature while still permitting lateral movement of said flat of said valve relative to said flat surface of said armature whereby said valve is free to center itself relative to said valve seat; and, a valve closing spring operatively positioned to normally bias said armature in an axial direction whereby said valve is in valve closing engagement with said valve seat.

* * * * *